US008991954B2

(12) United States Patent
Govyadinov et al.

(10) Patent No.: US 8,991,954 B2
(45) Date of Patent: Mar. 31, 2015

(54) FLUID EJECTION DEVICE WITH FLUID DISPLACEMENT ACTUATOR AND RELATED METHODS

(75) Inventors: Alexander Govyadinov, Corvallis, OR (US); Kianoush Naeli, Corvallis, OR (US); Tony S. Cruz-Uribe, Independence, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 14/125,829

(22) PCT Filed: Aug. 31, 2011

(86) PCT No.: PCT/US2011/050072

§ 371 (c)(1),
(2), (4) Date: Dec. 12, 2013

(87) PCT Pub. No.: WO2013/032471

PCT Pub. Date: Mar. 7, 2013

(65) Prior Publication Data

US 2014/0118431 A1 May 1, 2014

(51) Int. Cl.

| | |
|---|---|
| ***B41J 29/38*** | (2006.01) |
| ***B41J 2/135*** | (2006.01) |
| ***B41J 2/14*** | (2006.01) |
| ***B41J 2/045*** | (2006.01) |
| ***B41J 2/18*** | (2006.01) |

(52) U.S. Cl.

CPC ..... *B41J 2/18* (2013.01); *B41J 2/14233* (2013.01); *B41J 2002/14241* (2013.01); *B41J 2002/14338* (2013.01); *B41J 2002/14491* (2013.01)

USPC ..... 347/6; 347/9; 347/44; 347/48; 347/68

(58) Field of Classification Search

CPC ..... B41J 2002/14491; B41J 2/14233; B41J 2002/14241; B41J 2002/14338; B41J 2/18

USPC ..... 347/6, 9, 44, 47, 48, 54, 61, 68, 71

See application file for complete search history.

(56) References Cited

U.S. PATENT DOCUMENTS

| | | | | |
|---|---|---|---|---|
| 5,023,625 | A | 6/1991 | Bares et al. | |
| 6,123,412 | A | 9/2000 | Yamamoto et al. | |
| 6,244,694 | B1 | 6/2001 | Weber et al. | |
| 7,559,632 | B2 | 7/2009 | Kodama | |
| 7,604,327 | B2 | 10/2009 | Sugahara | |
| 8,029,108 | B2 * | 10/2011 | Takeuchi | 347/68 |
| 8,419,149 | B2 * | 4/2013 | Byun et al. | 347/10 |
| 2002/0184907 | A1 | 12/2002 | Vaiyapuri et al. | |
| 2008/0198208 | A1 | 8/2008 | Kyoso et al. | |
| 2009/0289976 | A1 | 11/2009 | Nishimura | |

FOREIGN PATENT DOCUMENTS

| | | |
|---|---|---|
| JP | 2006088575 | 4/2006 |
| JP | 2006147937 | 6/2006 |

* cited by examiner

*Primary Examiner* — Jannelle M Lebron

(74) *Attorney, Agent, or Firm* — Hewlett-Packard Patent Department

(57) ABSTRACT

In an embodiment, a method of circulating fluid in a fluid ejection device includes generating compressive and expansive fluid displacements of different durations from a first actuator located asymmetrically within a fluidic channel between a first fluid feedhole and a nozzle while generating no fluid displacements from a second actuator located asymmetrically within the channel between the nozzle and a second fluid feedhole.

19 Claims, 9 Drawing Sheets

FLUID EJECTION DEVICE WITH FLUID DISPLACEMENT ACTUATOR AND RELATED METHODS

BACKGROUND

Fluid ejection devices in inkjet printers provide drop-on-demand ejection of fluid drops. Inkjet printers produce images by ejecting ink drops through a plurality of nozzles onto a print medium, such as a sheet of paper. The nozzles are typically arranged in one or more arrays, such that properly sequenced ejection of ink drops from the nozzles causes characters or other images to be printed on the print medium as the printhead and the print medium move relative to each other. In a specific example, a thermal inkjet printhead ejects drops from a nozzle by passing electrical current through a heating element to generate heat and vaporize a small portion of the fluid within a firing chamber. Some of the fluid displaced by the vapor bubble is ejected from the nozzle. In another example, a piezoelectric inkjet printhead uses a piezoelectric material actuator to generate pressure pulses that force ink drops out of a nozzle.

Although inkjet printers provide high print quality at reasonable cost, their continued improvement depends in part on overcoming various operational challenges. For example, the release of air bubbles from the ink during printing can cause problems such as ink flow blockage, insufficient pressure to eject drops, and mis-directed drops. Pigment-ink vehicle separation (PIVS) is another problem that can occur when using pigment-based inks. PIVS is typically a result of water evaporation from ink in the nozzle area and pigment concentration depletion in ink near the nozzle area due to a higher affinity of pigment to water. During periods of storage or non-use, pigment particles can also settle or crash out of the ink vehicle which can impede or block ink flow to the firing chambers and nozzles in the printhead. Other factors related to "decap", such as evaporation of water or solvent can cause PIVS and viscous ink plug formation. Decap is the amount of time inkjet nozzles can remain uncapped and exposed to ambient environments without causing degradation in the ejected ink drops. Effects of decap can alter drop trajectories, velocities, shapes and colors, all of which can negatively impact the print quality of an inkjet printer.

BRIEF DESCRIPTION OF THE DRAWINGS

The present embodiments will now be described, by way of example, with reference to the accompanying drawings, in which.

DETAILED DESCRIPTION

Overview of Problem and Solution

Figure 1A:
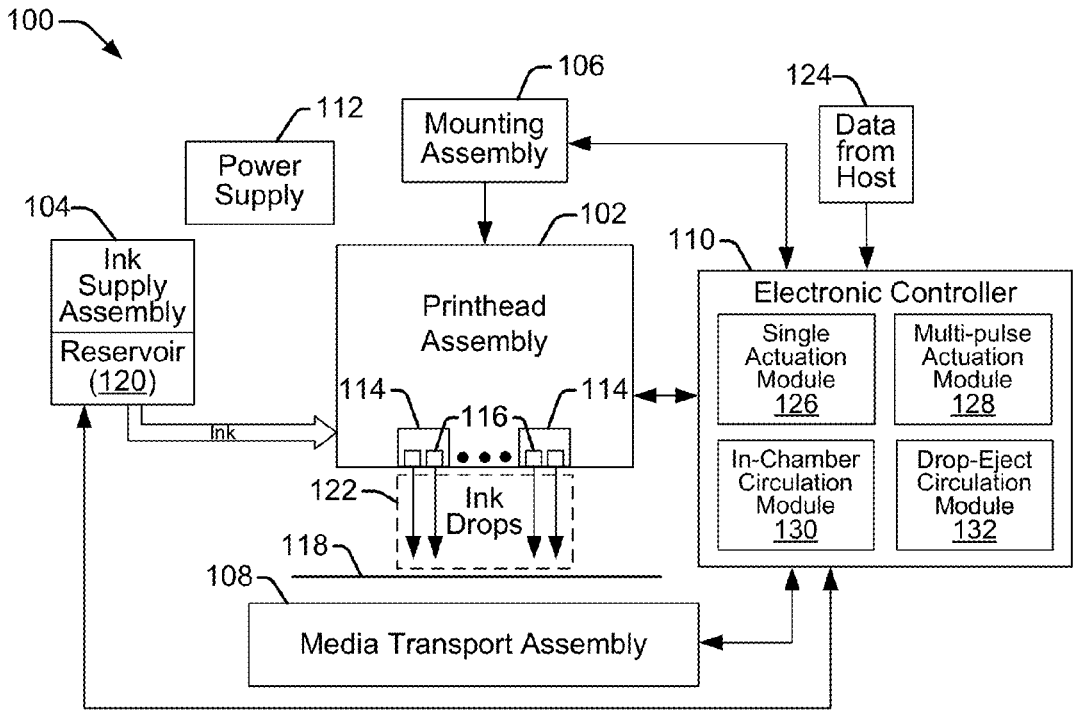
FIG. 1 illustrates an inkjet printing system suitable for incorporating a fluid ejection device and implementing methods of circulating fluid in a fluid ejection device as disclosed herein, according to an embodiment.

As noted above, various challenges have yet to be overcome in the development of inkjet printing systems. For example, inkjet printheads used in such systems sometimes have problems with ink blockage and/or clogging. One cause of ink blockage is an excess of air that accumulates as air bubbles in the printhead. When ink is exposed to air, such as while the ink is stored in an ink reservoir, additional air dissolves into the ink. The subsequent action of ejecting ink drops from the firing chamber of the printhead releases excess air from the ink which then accumulates as air bubbles. The bubbles move from the firing chamber to other areas of the printhead where they can block the flow of ink to the printhead and within the printhead. Bubbles in the chamber absorb pressure, reducing the force on the fluid pushed through the nozzle which reduces drop speed or prevents ejection.

Pigment-based inks can also cause ink blockage or clogging in printheads. Inkjet printing systems use pigment-based inks and dye-based inks, and while there are advantages and disadvantages with both types of ink, pigment-based inks are generally preferred. In dye-based inks the dye particles are dissolved in liquid so the ink tends to soak deeper into the paper. This makes dye-based ink less efficient and it can reduce the image quality as the ink bleeds at the edges of the image. Pigment-based inks, by contrast, consist of an ink vehicle and high concentrations of insoluble pigment particles coated with a dispersant that enables the particles to remain suspended in the ink vehicle. This helps pigment inks stay more on the surface of the paper rather than soaking into the paper. Pigment ink is therefore more efficient than dye ink because less ink is needed to create the same color intensity in a printed image. Pigment inks also tend to be more durable and permanent than dye inks as they smear less than dye inks when they encounter water.

One drawback with pigment-based inks, however, is that ink blockage can occur in the inkjet printhead due to factors such as prolonged storage and other environmental extremes that can result in poor out-of-box performance of inkjet pens. Inkjet pens have a printhead affixed at one end that is internally coupled to an ink supply. The ink supply may be self-contained within the printhead assembly or it may reside on the printer outside the pen and be coupled to the printhead through the printhead assembly. Over long periods of storage, gravitational effects on the large pigment particles, random fluctuations, and/or degradation of the dispersant can cause pigment agglomeration, settling or crashing. The build-up of pigment particles in one location can impede or completely block ink flow to the firing chambers and nozzles in the printhead, resulting in poor out-of-box performance by the printhead and reduced image quality from the printer. Other factors such as evaporation of water and solvent from the ink can also contribute to PIVS and/or increased ink viscosity and viscous plug formation, which can decrease decap performance and prevent immediate printing after periods of non-use.

Previous solutions have primarily involved servicing printheads before and after their use, as well as using various types of external pumps for circulating the ink through the printhead. For example, printheads are typically capped during non-use to prevent nozzles from clogging with dried ink. Prior to their use, nozzles can also be primed by spitting ink through them or using the external pump to purge the printhead with a continuous flow of ink. Drawbacks to these solutions include the inability to print immediately (i.e., on demand) due to the servicing time, and an increase in the total cost of ownership due to the consumption of ink during servicing. The use of external pumps for circulating ink through the printhead is typically cumbersome and expensive, involving elaborate pressure regulators to maintain backpressure at the nozzle entrance. Accordingly, decap performance, PIVS, the accumulation of air and particulates, and other causes of ink blockage and/or clogging in inkjet printing systems continue to be fundamental issues that can degrade overall print quality and increase ownership costs, manufacturing costs, or both.

Embodiments of the present disclosure reduce ink blockage and/or clogging in inkjet printing systems generally through the use of piezoelectric and other types of mechanically controllable fluid actuators that provide micro-circulation of fluid within fluidic channels and/or chambers of fluid ejection devices (e.g., inkjet printheads). Fluid actuators located asymmetrically (i.e., off-center, or eccentrically) within a fluidic channel, and a controller, enable directional fluid flow through and within the fluidic channels by controlling the durations of forward and reverse actuation strokes (i.e., pump strokes) that generate compressive fluid displacements (i.e., on forward pump strokes) and expansive or tensile fluid displacements (i.e., on reverse pump strokes).

In one embodiment, a fluid ejection device includes a fluidic channel having an inlet, an outlet and a nozzle. A first fluid displacement actuator is located asymmetrically within the channel between the inlet and the nozzle. A second fluid displacement actuator is located asymmetrically within the channel between the outlet and the nozzle. A controller controls fluid flow through the channel by generating compressive and expansive fluid displacements of different durations from at least one actuator.

In one embodiment, a method of circulating fluid in a fluid ejection device includes generating compressive and expansive fluid displacements of different durations from a first actuator located asymmetrically within a fluidic channel between an inlet and a nozzle, while generating no fluid displacements from a second actuator located asymmetrically within the channel between the nozzle and an outlet. In one implementation, the method includes generating compressive and expansive fluid displacements of different durations from the second actuator while generating no fluid displacements from the first actuator. In another implementation, the method includes alternating activation of the first and second actuators to generate compressive and expansive fluid displacements from both actuators.

In one embodiment, a method of circulating fluid in a fluid ejection device includes simultaneously activating a first and second actuator to generate compressive and expansive fluid displacements, where the first and second actuators alternate between compressive and expansive fluid displacements such that they do not generate compressive or expansive fluid displacements at the same time. The first actuator is located asymmetrically within a fluidic channel between an inlet and a nozzle, and the second actuator is located asymmetrically within the channel between the nozzle and an outlet. A nozzle and a chamber are located between the actuators, and the simultaneous activation of the actuators creates a fluidic flow back and forth between the actuators. In one implementation, simultaneously activating the first and second actuator includes activating the first and second actuators to generate concurrent compressive fluid displacements having different compressive displacement magnitudes to eject a fluid drop from the nozzle and create a net directional fluid flow through the channel.

Illustrative Embodiments

FIG. 1 illustrates an inkjet printing system 100 suitable for incorporating a fluid ejection device and implementing methods of circulating fluid in a fluid ejection device as disclosed herein, according to an embodiment of the disclosure. In this embodiment, a fluid ejection device 114 is disclosed as a fluid drop jetting printhead 114. Inkjet printing system 100 includes an inkjet printhead assembly 102, an ink supply assembly 104, a mounting assembly 106, a media transport assembly 108, an electronic controller 110, and at least one power supply 112 that provides power to the various electrical components of inkjet printing system 100. Inkjet printhead assembly 102 includes at least one printhead 114 that ejects drops of ink through a plurality of orifices or nozzles 116 toward a print medium 118 so as to print onto print medium 118. Print media 118 can be any type of suitable sheet or roll material, such as paper, card stock, transparencies, Mylar, polyester, plywood, foam board, fabric, canvas, and the like. Nozzles 116 are typically arranged in one or more columns or arrays such that properly sequenced ejection of ink from nozzles 116 causes characters, symbols, and/or other graphics or images to be printed on print media 118 as inkjet printhead assembly 102 and print media 118 are moved relative to each other.

Figure 1B:
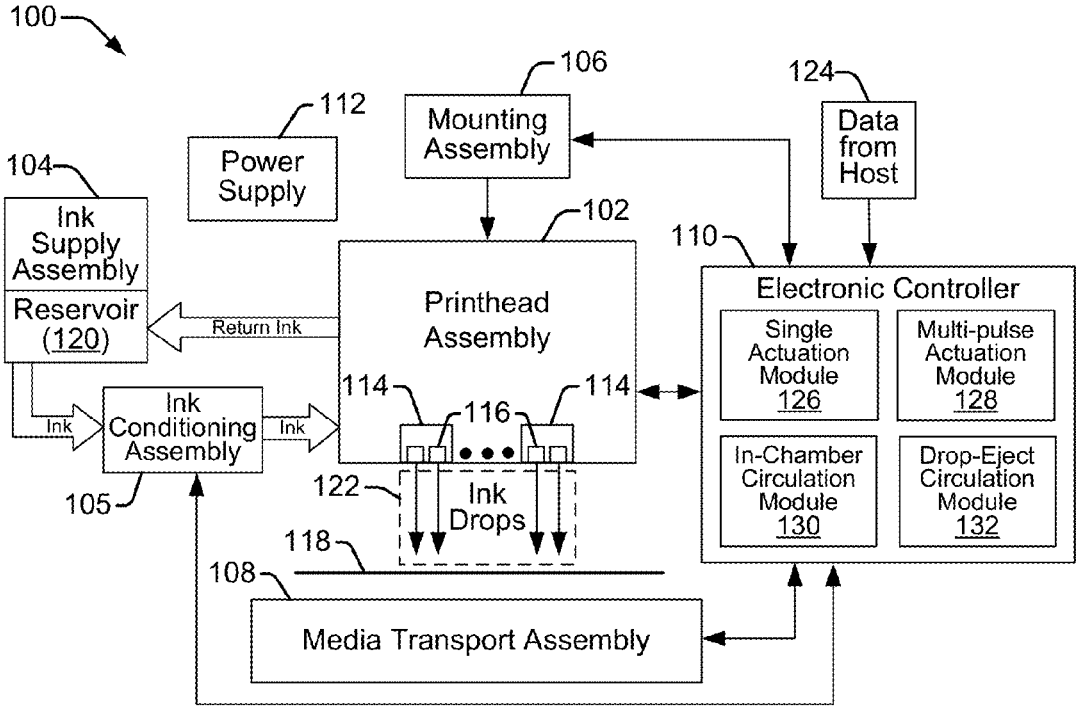

Ink supply assembly 104 supplies fluid ink to printhead assembly 102 from an ink storage reservoir 120 through an interface connection, such as a supply tube. The reservoir 120 may be removed, replaced, and/or refilled. In one embodiment, as shown in FIG. 1*a*, ink supply assembly 104 and inkjet printhead assembly 102 form a one-way ink delivery system. In a one-way ink delivery system, substantially all of the ink supplied to inkjet printhead assembly 102 is consumed during printing. In another embodiment, as shown in FIG. 1*b*, ink supply assembly 104 and inkjet printhead assembly 102 form a recirculating ink delivery system. In a recirculating ink delivery system, only a portion of the ink supplied to printhead assembly 102 is consumed during printing. Ink not consumed during printing is returned to ink supply assembly 104.

In one embodiment, ink supply assembly 104 includes pumps and pressure regulators (not specifically illustrated), enabling ink supply assembly 104 to supply ink to printhead assembly 102 under pressure. In one embodiment, ink is supplied to printhead assembly 102 through an ink conditioning assembly 105. Conditioning in the ink conditioning assembly 105 can include filtering, pre-heating, pressure surge absorption, and degassing. During normal operation of printing system 100, ink is drawn under negative pressure from the printhead assembly 102 to the ink supply assembly 104. The pressure difference between the inlet and outlet to the printhead assembly 102 provides an appropriate back-pressure at the nozzles 116, which is usually on the order of between negative 1" and negative 10" of H2O.

Mounting assembly 106 positions inkjet printhead assembly 102 relative to media transport assembly 108, and media transport assembly 108 positions print media 118 relative to inkjet printhead assembly 102. Thus, a print zone 122 is defined adjacent to nozzles 116 in an area between inkjet printhead assembly 102 and print media 118. In one embodiment, inkjet printhead assembly 102 is a scanning type printhead assembly. As such, mounting assembly 106 includes a carriage for moving inkjet printhead assembly 102 relative to media transport assembly 108 to scan print media 118. In another embodiment, inkjet printhead assembly 102 is a non-scanning type printhead assembly. As such, mounting assembly 106 fixes inkjet printhead assembly 102 at a prescribed position relative to media transport assembly 108 while media transport assembly 108 positions print media 118 relative to inkjet printhead assembly 102.

Electronic printer controller 110 typically includes a processor, firmware, software, one or more memory components including volatile and no-volatile memory components, and other printer electronics for communicating with and controlling inkjet printhead assembly 102, mounting assembly 106, and media transport assembly 108. Electronic controller 110 receives data 124 from a host system, such as a computer, and temporarily stores data 124 in a memory. Typically, data 124 is sent to inkjet printing system 100 along an electronic, infrared, optical, or other information transfer path. Data 124 represents, for example, a document and/or file to be printed. As such, data 124 forms a print job for inkjet printing system 100 and includes one or more print job commands and/or command parameters.

In one embodiment, electronic printer controller 110 controls inkjet printhead assembly 102 for ejection of ink drops from nozzles 116. Thus, electronic controller 110 defines a pattern of ejected ink drops which form characters, symbols, and/or other graphics or images on print media 118. The pattern of ejected ink drops is determined by the print job commands and/or command parameters. In one embodiment, electronic controller 110 includes software instruction modules stored in a memory and executable on controller 110 (i.e., a processor of controller 110) to control the operation of one or more fluid displacement actuators integrated within a fluid ejection device 114. The software instruction modules include single actuation module 126, multi-pulse actuation module 128, in-chamber circulation module 130 and drop-eject circulation module 132. In general, modules 126, 128, 130 and 132 execute on controller 110 to control the timing, duration and amplitude of compressive and expansive fluid displacements (i.e., forward and reverse pumping strokes, respectively) generated by the fluid displacement actuators in a fluid ejection device 114. Execution of modules 126, 128, 130 and 132 on controller 110 controls the direction, rate and timing of fluid flow within fluid ejection devices 114.

In the described embodiments, inkjet printing system 100 is a drop-on-demand piezoelectric inkjet printing system where a fluid ejection device 114 comprises a piezoelectric inkjet (PIJ) printhead 114. The PIJ printhead 114 includes a multilayer MEMS die stack that includes thin film piezoelectric fluid displacement actuators with control and drive circuitry. The actuators are controlled to generate fluid displacements within fluidic channels and/or chambers. The fluid displacements can force fluid drops out of chambers through nozzles 116, as well as generate net directional fluid flow through the channels and/or back-and-forth fluid movement within chambers. In one implementation, inkjet printhead assembly 102 includes a single PIJ printhead 114. In another implementation, inkjet printhead assembly 102 includes a wide array of PIJ printheads 114.

Although fluid ejection device 114 is described herein as a PIJ printhead 114 having piezoelectric fluid displacement actuators, the fluid ejection device 114 is not limited to this specific implementation. Other types of fluid ejection devices 114 implementing a variety of other types of fluid displacement actuators are contemplated. For example, fluid ejection devices 114 may implement electrostatic (MEMS) actuators, mechanical/impact driven actuators, voice coil actuators, magneto-strictive drive actuators, and so on.

Figure 2:
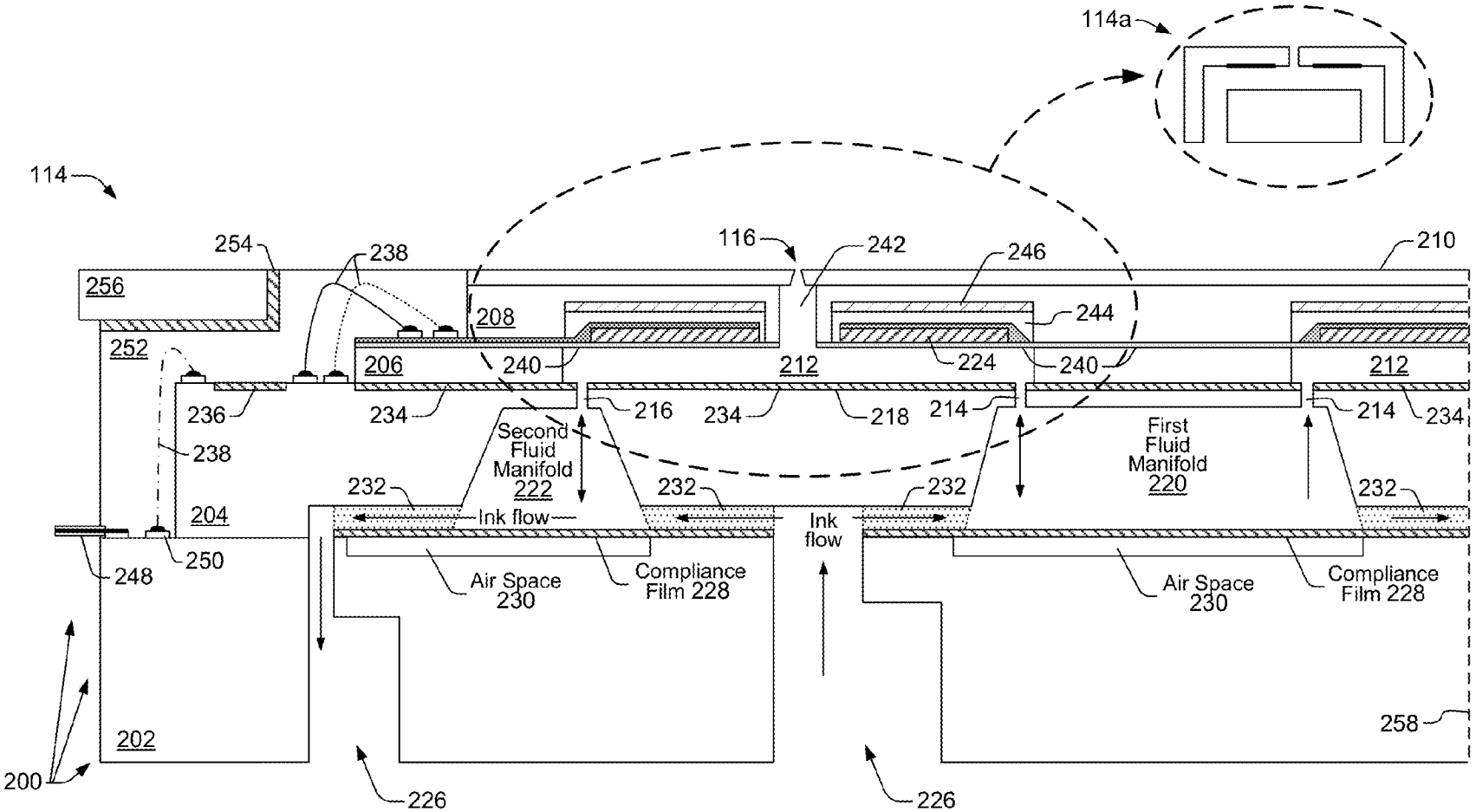
FIG. 2 shows a partial cross-sectional side view of an example fluid ejection device, according to an embodiment.

FIG. 2 shows a partial cross-sectional side view of an example fluid ejection device 114, according to an embodiment of the disclosure. A blown-up and simplified portion of the fluid ejection device 114*a*, discussed below with reference to FIGS. 3-10, is set off in FIG. 2 with dotted lines. In general, fluid ejection device 114 includes a die stack 200 with multiple die layers that each have different functionality. The layers in the die stack 200 include a first (i.e., bottom) substrate die 202, a second circuit die 204 (or ASIC die), a third actuator/chamber die 206, a fourth cap die 208, and a fifth nozzle layer 210 (or nozzle plate). In some embodiments, the cap die 208 and nozzle layer 210 are integrated as a single layer. There is also usually a non-wetting layer (not shown) on top of the nozzle layer 210 that includes a hydrophobic coating to help prevent ink puddling around nozzles 116. Each layer in the die stack 200 is typically formed of silicon, except for the non-wetting layer and sometimes the nozzle layer 210. In some embodiments, the nozzle layer 210 may be formed of stainless steel or a durable and chemically inert polymer such as polyimide or SU8. The layers are bonded together with a chemically inert adhesive such as epoxy (not shown). In the illustrated embodiment, the die layers have fluid passageways such as slots, channels, or holes for conducting ink to and from pressure chambers 212. Each pressure chamber 212 includes a first fluid feed hole 214 and a second fluid feed hole 216 located in the floor 218 of the chamber (i.e., opposite the nozzle-side of the chamber) that are in fluid communication with an ink distribution manifold that includes first fluid manifold 220 and second fluid manifold 222. The floor 218 of the pressure chamber 212 is formed by the surface of the circuit layer 204. The first and second fluid feed holes 214 and 216 are on opposite sides of the floor 218 of the chamber 212 where they pierce the circuit layer 204 die and enable ink to be circulated through the chamber 212. Fluid displacement actuators 224 (i.e., piezoelectric actuators) are on a flexible membrane that serves as a roof to the chamber 212 and is located opposite the chamber floor 218. Thus, the fluid displacement actuators 224 are located on the same side of the chamber 212 as are the nozzles 116 (i.e., on the roof or top-side of the chamber).

The bottom substrate die 202 includes fluidic passageways 226 through which fluid is able to flow to and from pressure chambers 212 via first and second fluid manifolds 220 and 222. Substrate die 202 supports a thin compliance film 228 configured to alleviate pressure surges from pulsing fluid flows through the fluid distribution manifold due to start-up transients and fluid ejections in adjacent nozzles, for example. The compliance film 228 spans a gap in the substrate die 202 that forms a cavity or air space 230 on the backside of the compliance to allow it to expand freely in response to fluid pressure surges in the manifold.

Circuit die 204 is the second die in die stack 200 and is located above the substrate die 202. Circuit die 204 includes the fluid distribution manifold that comprises the first and second fluid manifolds 220 and 222. The first fluid manifold 220 provides fluid flow to and from chamber 212 via the first fluid feed hole 214, while the second fluid feed hole 216 allows fluid to exit the chamber 212 into the second fluid manifold 222. Circuit die 204 also includes fluid bypass channels 232 that permit some fluid coming into the first fluid manifold 220 to bypass the pressure chamber 212 and flow directly into the second fluid manifold 222 through the bypass 232. Circuit die 204 includes CMOS electrical circuitry 234 implemented in an ASIC 234 and fabricated on its upper surface adjacent the actuator/chamber die 206. ASIC 234 includes ejection control circuitry that controls the pressure pulsing of fluid displacement actuators 224 (i.e., piezoelectric actuators). Circuit die 204 also includes piezoelectric actuator drive circuitry/transistors 236 (e.g., FETs) fabricated on the edge of the die 204 outside of bond wires 238. Drive transistors 236 are controlled (i.e., turned on and off) by control circuitry in ASIC 234.

The next layer in die stack 200 located above the circuit die 204 is the actuator/chamber die 206 ("actuator die 206", hereinafter). The actuator die 206 is adhered to circuit die 204 and includes pressure chambers 212 having chamber floors 218 that comprise the adjacent circuit die 204. As noted above, the chamber floor 218 additionally comprises control circuitry such as ASIC 234 fabricated on circuit die 204 which forms the chamber floor 218. Actuator die 206 additionally includes a thin-film, flexible membrane 240 such as silicon dioxide, located opposite the chamber floor 218 that serves as the roof of the chamber. Above and adhered to the flexible membrane 240 are fluid displacement actuators 224. In the present embodiment, fluid displacement actuators 224 include a thin-film piezoelectric material such as a piezoceramic material that stresses mechanically in response to an applied electrical voltage. When activated, piezoelectric actuator 224 physically expands or contracts which causes the laminate of piezoceramic and membrane 240 to flex. This flexing displaces fluid in the chamber 212 generating pressure waves in the pressure chamber 212 that eject fluid drops through the nozzle 116 and/or circulate fluid within and through the chamber 212 and first and second fluid feed holes 214 and 216. The flexible membrane 240 and fluid displacement actuator 224 (piezoelectric actuator 224) are split by descender 242 that extends between the pressure chamber 212 and nozzle 116. Thus, the fluid displacement actuator 224 is a split actuator 224 having a fluid displacement actuator 224, or segment of fluid displacement actuator 224, on each side of the chamber 212.

The cap die 208 is adhered above the actuator die 206 and forms a sealed cap cavity 244 over piezoelectric actuator 224 that encapsulates and protects fluid displacement actuators 224. Cap die 208 includes the descender 242 noted above, which is a channel in the cap die 208 that extends between the pressure chamber 212 and nozzle 116 that enables fluid to travel from the chamber 212 and out of the nozzle 116 during drop ejection events caused by pressure waves from fluid displacement actuator 224. The nozzle layer 210, or nozzle plate, is adhered to the top of cap die 208 and has nozzles 116 formed therein.

Figure 3A:
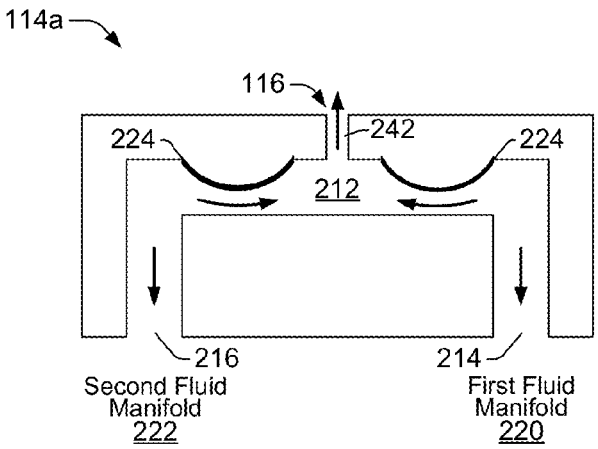
FIG. 3*a* shows a fluid ejection device in a normal drop ejection mode, according to an embodiment.

FIG. 3*a* shows a blown-up and simplified portion of a cross-sectional view of a fluid ejection device 114*a* as in FIG. 2, in a normal drop ejection mode, according to an embodiment of the disclosure. In this embodiment, both fluid displacement actuators 224 operate simultaneously with sufficient outward (i.e., convex) deflection and displacement to eject fluid drops of desired speed and volume from the pressure chamber 212 and through nozzle 116. Both fluid displacement actuators 224 deflect outwardly in forward pumping strokes that temporarily reduce the volume in and around pressure chamber 212, generating compressive fluid displacements. Pressure waves from the simultaneous compressive fluid displacements of both actuators 224 cause fluid to eject from nozzle 116, as well as create fluid flow through the first and second fluid feed holes 214 and 216 into manifolds 220 and 222, respectively (as indicated by fluid flow arrows).

Figure 3B:
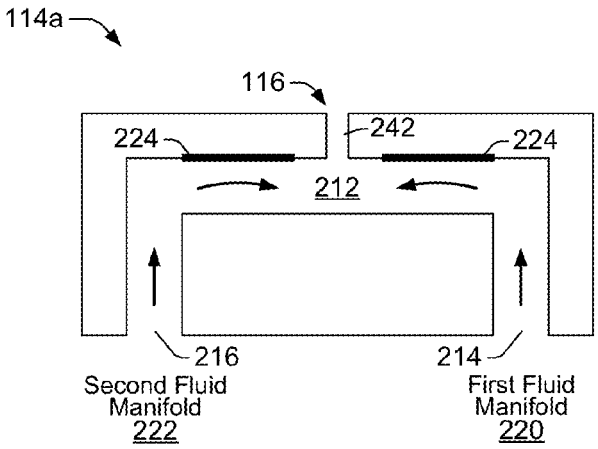
FIG. 3*b* shows the fluid ejection device in a normal fluid refill mode, according to an embodiment.

FIG. 3*b* shows a blown-up and simplified portion of a cross-sectional view of a fluid ejection device 114*a* in a normal fluid refill mode, according to an embodiment of the disclosure. In this embodiment, a simultaneous reverse or inward deflection of the actuators 224 back to their flat or neutral state draws fluid back into the pressure chamber 212 to refill the chamber in preparation for the next drop ejection. In some implementations, the reverse or inward deflection of the actuators 224 deflects the actuators 224 past their flat or neutral state and up into the cap cavity 244 in a concave deflection. As shown in FIG. 3*b*, both fluid displacement actuators 224 have deflected back to their initial flat or neutral state (i.e., resting state). The deflection back to the initial state retracts the actuators 224 back out of the space in and around pressure chamber 212 in a reverse pumping stroke that increases the volume in the chamber area and generates expansive fluid displacements. The expansive fluid displacements create fluid flow back into the chamber 212 through the first and second fluid feed holes 214 from manifolds 220 and 222, respectively (as indicated by fluid flow arrows), refilling the chamber 212 with fluid in preparation for the next drop ejection event. During normal drop ejections and fluid refills as shown in FIGS. 3*a* and 3*b*, no micro-circulation of fluid occurs other than the movement of fluid to refill the pressure chamber 212.

Figure 3C:
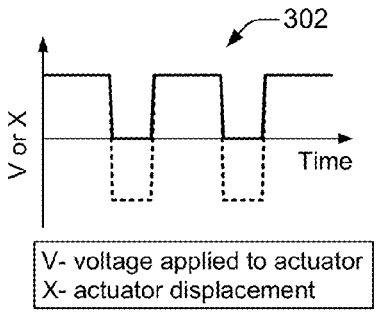
FIG. 3*c* shows a graph of an example voltage waveform (V) applied to actuators to achieve actuator deflections (X) that generate drop ejections and corresponding fluid refills, according to an embodiment.

FIG. 3*c* shows a graph 302 of an example voltage waveform (V) applied to the actuators 224 to achieve the actuator deflections (X) shown in FIGS. 3*a* and 3*b* that generate drop ejections and the corresponding fluid refills, according to an embodiment of the disclosure. When the applied voltage increases, the actuator 224 deflects in an outward (i.e., convex) deflection that generates a compressive fluid displacement (i.e., the fluid is displaced as it is compressed within the area in and around chamber 212). When the applied voltage decreases, the actuator 224 deflects back to its initial flat or neutral state (i.e., resting state) which generates an expansive fluid displacement (i.e., the fluid is displaced as it is pulled back into the increasing volume in and around chamber 212). The dotted line voltage waveform in FIG. 3*c* represents an alternate voltage drive waveform whose negative voltage swing deflects the actuator 224 inward (i.e., concave) past its normal resting state and into the cap cavity 244 of the cap die 208 (see FIG. 2), temporarily increasing the volume in and around chamber 212 further, and generating a greater expansive fluid displacement. Thus, the dotted line voltage waveform drives the actuator 224 to deflect outward into the channel 500 generating a compressive fluid displacement, and then back past its normal resting position in an opposite deflection that extends the actuator 224 up into the cap cavity 244, generating a greater expansive fluid displacement. Although not illustrated by the voltage waveform of FIG. 3*c*, whenever a piezoelectric actuator is deflected above the flat or neutral position (i.e., concave shape), the voltage is actually much lower than for deflections of the actuator into the chamber (whether for pumping or recirculation). This is to prevent electric fields acting against the polarization of the piezoceramic from degrading the polarization (depoling) which can lessen subsequent deflections, degrading the printing and pumping performance.

Although fluid displacement actuators 224 are discussed throughout as being located on the nozzle-side of the chamber 212 (i.e., in the cap die layer 208 on the same side of the chamber 212 as nozzle 116), in another embodiment shown in FIG. 4, the actuators 224 can be located on the circuit die layer 204 (see FIG. 2) which is opposite the nozzle side. In yet another embodiment (not shown), fluid displacement actuators 224 can be located on both the nozzle-side of the chamber 212 and on the side opposite the nozzle 116. FIG. 4 shows a simplified cross-sectional view of a fluid ejection device 114*a* with fluid displacement actuators 224 located on the circuit die layer 204, opposite the nozzle 116, according to an embodiment of the disclosure.

Figure 4A:
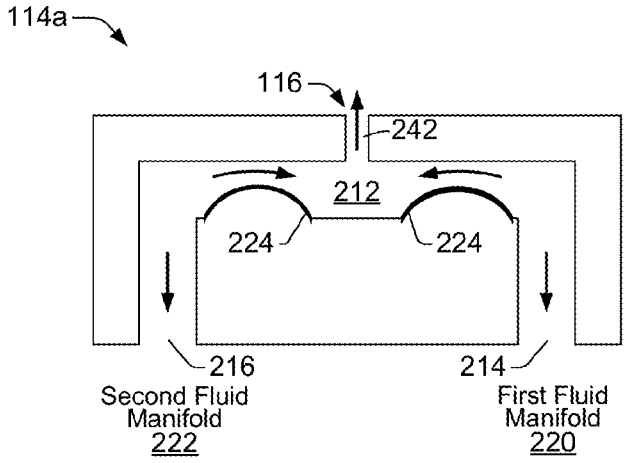
FIG. 4*a* shows a fluid ejection device in a normal drop ejection mode with actuators deflecting into a fluidic channel in forward pumping strokes that generate compressive fluid displacements within the channel, according to an embodiment.
Figure 4B:
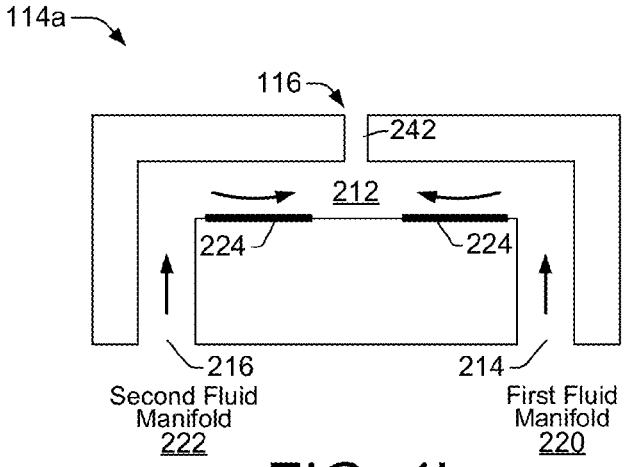
FIG. 4*b* shows a fluid ejection device in a normal fluid refill mode with actuators back to an initial or resting state, according to an embodiment.

In FIG. 4*a* the fluid ejection device 114*a* is shown in a normal drop ejection mode similar to that discussed regarding FIG. 3*a*, with actuators 224 deflecting in outward (i.e., convex) deflections or forward pumping strokes that generate compressive fluid displacements, according to an embodiment of the disclosure. In FIG. 4*b* the fluid ejection device 114*a* is shown in a normal fluid refill mode similar to that discussed regarding FIG. 3*b*, with actuators 224 deflected back to an initial, flat or neutral state (i.e., resting state), according to an embodiment of the disclosure. The actuators have retracted back in a reverse pumping stroke that generates expansive fluid displacements, refilling the chamber 212 with fluid.

Figure 4C:
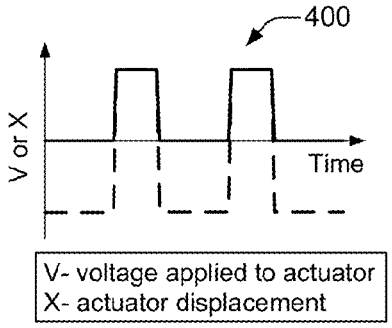
FIG. 4*c* shows a graph of an example voltage waveform (V) applied to actuators to achieve actuator deflections (X) that generate drop ejections and corresponding fluid refills, according to an embodiment.

FIG. 4*c* shows a graph 400 of an example voltage waveform (V) applied to the actuators 224 to achieve the actuator deflections (X) shown in FIGS. 4*a* and 4*b* that generate drop ejections and the corresponding fluid refills, according to an embodiment of the disclosure. When the applied voltage increases, it causes an outward (i.e., convex) deflection in the actuator 224 that generates a compressive fluid displacement, and when the applied voltage decreases, it causes an inward (i.e., concave) deflection in the actuator 224 back to its initial, flat or neutral state, generating an expansive fluid displacement. The dotted line voltage waveform in FIG. 4*c* represents an alternate voltage drive waveform whose negative voltage swing deflects the actuator 224 past its normal resting state and into a cavity (not shown) in the circuit layer 204, temporarily increasing the volume in and around the chamber 212 and generating an expansive fluid displacement. Thus, the dotted line voltage waveform drives the actuator 224 to deflect outward, generating a compressive fluid displacement, and then back past its normal resting position in an opposite deflection that extends the actuator 224 into the circuit layer 204, generating an expansive fluid displacement. As noted above with respect to FIGS. 3*a* and 3*b*, during normal drop ejections and fluid refills as shown in FIGS. 4*a* and 4*b*, no micro-circulation of fluid occurs other than the movement of fluid to refill the pressure chamber 212.

FIGS. 5-10 illustrate modes of operation of fluid displacement actuators 224 that provide micro-circulation of fluid within fluidic channels and/or chambers of fluid ejection devices 114 (e.g., inkjet printheads). In general, fluid actuators 224 located asymmetrically (i.e., off-center, or eccentrically) within a fluidic channel, and that are controlled (e.g., by a controller 110) to generate compressive and expansive fluid displacements whose durations are asymmetric, function both as fluid drop ejectors to eject fluid drops through nozzles 116 as well as fluid circulation elements (i.e., pumps) to circulate fluid through and within fluidic channels. Accordingly, to facilitate this description, a fluidic channel 500 is defined and shown within the fluid ejection device 114*a* for each of FIGS. 5-10. Fluidic channel 500 includes the fluidic volume within fluid ejection device 114*a* that extends from the first fluid manifold 220 at the first fluid feed hole 214 around to the second fluid manifold 222 at the second fluid feed hole 216. The chamber 212 is part of the fluidic channel 500, and the fluidic channel 500 runs through chamber 212. Thus, references herein to the fluidic channel 500 also include the chamber 212 as part and parcel of the channel 500. Each of the two fluid displacement actuators 224 is located in the fluid channel 500 asymmetrically (i.e., off-center, or eccentrically) with respect to the length of the channel 500. The chamber 212 is located between the two actuators 224.

Figure 5A:
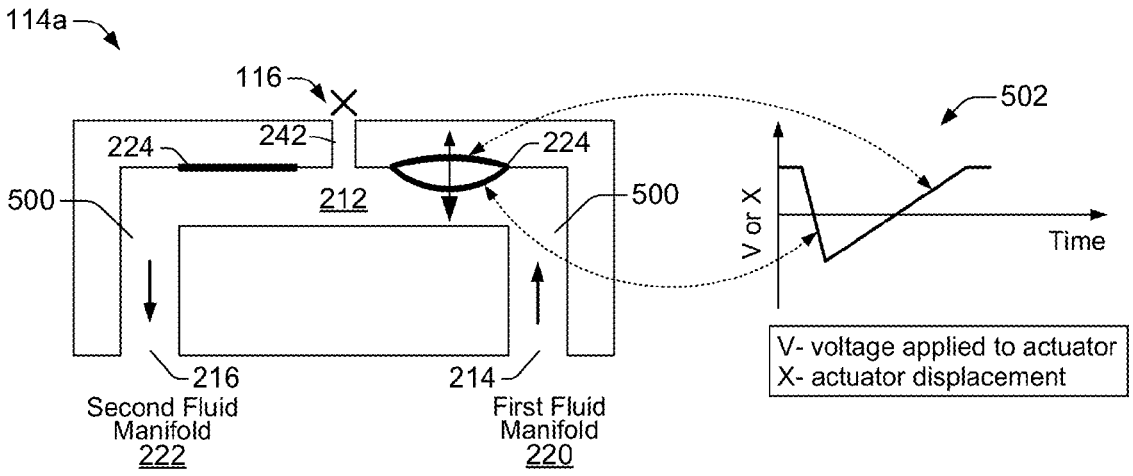
FIGS. 5*a* and 5*b* show a cross-sectional view of a fluid ejection device with fluid displacement actuators operating in a single actuator pumping mode and a graph of example voltage waveforms (V) applied to the actuators, according to embodiments.
Figure 5B:
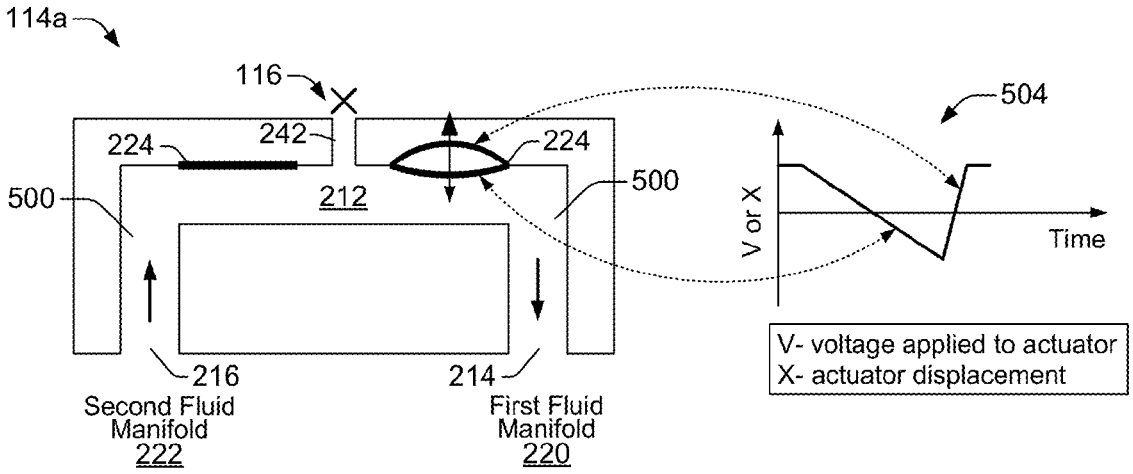

FIG. 5 shows a simplified cross-sectional view of a fluid ejection device 114*a* with fluid displacement actuators 224 operating in a single actuator pumping mode, according to an embodiment of the disclosure. In both FIGS. 5*a* and 5*b*, the single actuator 224 on the right side of the figures is arbitrarily shown and discussed as being the actuator operating as a fluidic pump to achieve net fluid flow through channel 500. The opposite flow effect is achieved when the single actuator 224 on the left side of the figures operates as the fluidic pump. Controller 110 controls the single actuator pumping mode operation of the actuator 224 of FIG. 5 by execution of software instructions in the single actuation module 126. Accordingly, controller 110 through execution of module 126 determines which actuator 224 (on the left or the right) operates at any given time to provide a single actuator fluid pumping effect. FIGS. 5*a* and 5*b* also show a graph of an example voltage waveform (V) applied to the actuator 224 to achieve the illustrated actuator deflections (X) that generate the pumping effect and the resulting net fluid flow through the channel 500 shown by the fluid flow direction arrows. The large X at the top of nozzle 116 is intended to indicate that there is no fluid flow through the nozzle 116.

In general, an inertial pumping mechanism enables a pumping effect from a fluid displacement actuator 224 in a fluidic channel 500 based on two factors. These factors are the asymmetric (i.e., off-center, or eccentric) placement of the actuator 224 in the channel 500 with respect to the length of the channel, and the asymmetric operation of the actuator 224. As shown in FIG. 5, each of the two fluid displacement actuators 224 is located asymmetrically (i.e., off-center, or eccentrically) in the channel 500 with respect to the length of the channel. This asymmetric actuator placement, along with asymmetric operation of the actuator 224 (i.e., control of the timing, duration and amplitude of fluid displacements), enable the inertial pumping mechanism of the actuator 224.

Referring generally to FIGS. 5*a* and 5*b*, the asymmetric location of the actuator 224 in the fluidic channel 500 creates a short side of the channel 500 that extends from the first fluid feed hole 214 to the actuator 224, and a long side of the channel 500 that extends from the actuator 224 to the second fluid feed hole 216. The asymmetric location of the actuator 224 within the channel 500 creates an inertial mechanism that drives fluidic diodicity (net fluid flow) within the channel 500. A fluidic displacement from the actuator 224 generates a wave propagating within the channel 500 that pushes fluid in two opposite directions. The more massive part of the fluid contained in the longer side of the channel 500 has larger mechanical inertia at the end of a forward fluid actuator pump stroke (i.e., deflection of the actuator 224 into the channel 500 causing a compressive fluidic displacement). Therefore, this larger body of fluid reverses direction more slowly than the fluid in the shorter side of the channel 500. The fluid in the shorter side of the channel 500 has more time to pick up the mechanical momentum during the reverse fluid actuator pump stroke (i.e., deflection of the actuator 224 back to its initial resting state or further, causing an expansive fluidic displacement). Thus, at the end of the reverse stroke the fluid in the shorter side of the channel 500 has larger mechanical momentum than the fluid in the longer side of the channel 500. As a result, the net fluidic flow moves in the direction from the shorter side of the channel 500 to the longer side of the channel 500, as indicated by the black direction arrows in FIGS. 5*a* and 5*b*. The net fluid flow is a consequence of the non-equal inertial properties of two fluidic elements (i.e., the short and long sides of the channel 500).

The asymmetric operation of the actuator 224 within the channel 500 is the second factor that enables the inertial pumping mechanism of the fluid displacement actuator 224. The operation of the actuator 224 on the right side of fluid ejection device 114*a* in FIG. 5*a* shows a shorter compressive displacement (i.e., the displacement has lesser duration with more deflection of the actuator 224 into the channel 500) and a longer expansive displacement (i.e., the displacement is longer in duration with less deflection of the actuator 224 out of the channel 500) of the actuator 224. In one embodiment, the asymmetric operation of the actuator 224 is controlled by controller 110 through the conjugated ramp voltage waveform in graph 502. Although similar conjugated ramp voltage waveforms are discussed throughout as controlling the asymmetric operation of actuators 224, controlling the operation of the actuators 224 in an asymmetric manner can be achieved using other types of drive waveforms. The dotted line arrows in FIG. 5*a* between the actuator 224 and the conjugated ramp voltage waveform in graph 502 show that the stronger compressive displacement is associated with a voltage change that is temporally short and more steeply sloped, while the smaller expansive displacement is associated with a voltage change that is temporally longer and gently sloped. The durations and amplitudes of the waveforms control the durations and magnitudes of the displacements from the actuator 224. Thus, voltage drive waveforms having asymmetric durations and amplitudes controlled by controller 110 drive asymmetric operation of the actuator 224. With this manner of asymmetric operation of actuator 224, the direction of net fluid flow through the channel 500 is from the short side at the first fluid feed hole 214 toward the long side at the second fluid feed hole 216. Note that if this same manner of asymmetric operation is implemented with respect to the actuator 224 on the left side in FIG. 5*a*, the direction of net fluid flow through the channel 500 will be reversed.

The actuator 224 in FIG. 5*b* on the right side of fluid ejection device 114*a* is shown operating in an opposite manner than that shown in FIG. 5*a*. That is, the operation of the actuator 224 on the right side of FIG. 5*b* shows a longer compressive displacement (i.e., the displacement is longer in duration with less deflection of the actuator 224 into the channel 500) and a shorter expansive displacement (i.e., the displacement is shorter with more deflection of the actuator 224 out of the channel 500) of the actuator 224. The conjugated ramp voltage waveform in graph 502 and dotted line arrows show that the longer/weaker compressive displacement is associated with a voltage change that is temporally long and gently sloped, while the smaller expansive displacement is associated with a voltage change that is temporally shorter and steeply sloped. With this manner of asymmetric operation of actuator 224, the direction of net fluid flow through the channel 500 is reversed from that shown in FIG. 5*a*. The direction of net fluid flow through the channel 500 is from the long side at the second fluid feed hole 216 toward the short side at the first fluid feed hole 214. Note that if this same manner of asymmetric operation is implemented with respect to the actuator 224 on the left side in FIG. 5*a*, the direction of net fluid flow through the channel 500 will be reversed.

Figure 6:
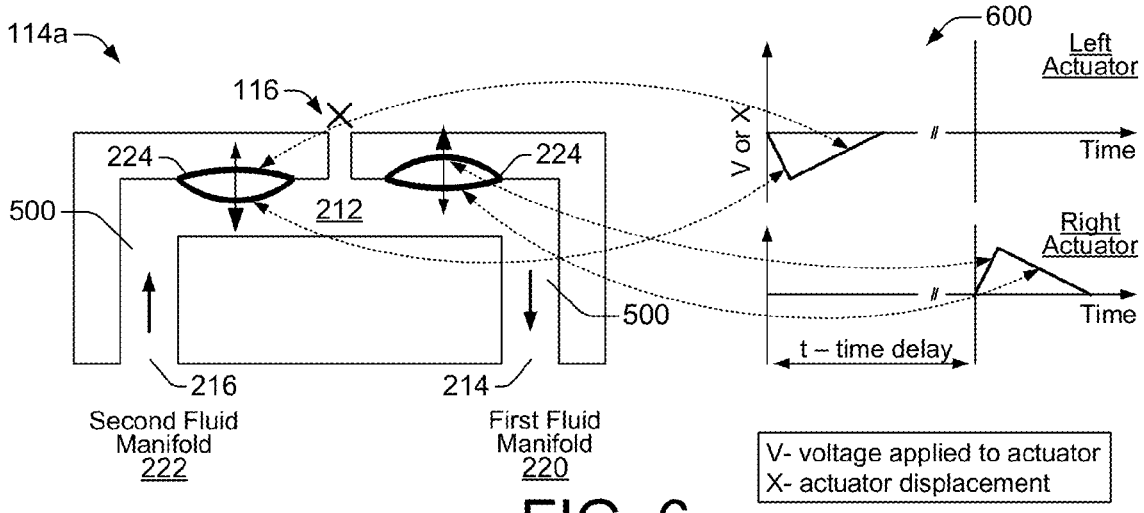
FIG. 6 shows a cross-sectional view of a fluid ejection device with fluid displacement actuators operating in an alternating multi-pulse actuation mode, according to an embodiment.

FIG. 6 shows a simplified cross-sectional view of a fluid ejection device 114*a* with fluid displacement actuators 224 operating in an alternating multi-pulse actuation mode, according to an embodiment of the disclosure. The multi-pulse actuation module 128 executing on controller 110 controls the actuators 224 in a multi-pulse actuation to activate the actuators in different compressive and expansive fluid displacement combinations. The multi-pulse actuation provides a double pumping action that results in stronger net directional fluid flow through channel 500.

As shown in FIG. 6, the multi-pulse actuation module 128 controls the right and left actuators 224 so that they are activated in an alternating manner. For example, first the left side actuator generates a compressive fluid displacement and an expansive fluid displacement. The stronger compressive displacement and larger deflection of the left actuator is associated (by dotted arrow lines) with a voltage change in the conjugated ramp voltage waveform of graph 600 that is temporally shorter and more steeply sloped, while the expansive displacement and lesser deflection of the left actuator is associated with a voltage change that is temporally longer and more gradually sloped. As mentioned in the discussion of FIG. 5 above, this operation of the left actuator results in net fluid flow through the channel 500 in a direction from the short side of channel 500 (with respect to the left actuator) at the second fluid feed hole 216 toward the long side at the first fluid feed hole 214.

After a time delay during which the left side actuator is activated, the multi-pulse actuation module 128 activates the right side actuator to generate a compressive fluid displacement and an expansive fluid displacement. The time delay is at least long enough in duration to encompass the activation of the left actuator, but may in some embodiments be longer in duration such that activation of the right side actuator does not begin directly after activation of the left side actuator. Graph 600 shows the stronger expansive displacement of the right actuator is associated (by dotted arrow lines) with a voltage change that is temporally shorter and more steeply sloped than the compressive displacement, which is associated with a voltage change that is temporally longer and more gradually sloped. As mentioned in the discussion of FIG. 5 above, this operation of the right side actuator results in net fluid flow through the channel 500 in a direction from the long side of channel 500 (with respect to the right actuator) at the second fluid feed hole 216 toward the short side at the first fluid feed hole 214. The double action pumping from the left and right side actuators in a phase defined by graph 600 and the following equation result in a stronger net fluid flow through channel 500 than is available when only one actuator operates as a pump:

Time delay: $t=d/v$ (v: circulation flow rate/velocity; d: mean distance between left & right actuators)

Phase delay: $\phi=2\pi t/T$ (T: actuation period=1/(actuation frequency))

The multi-pulse actuation module 128 controls the right and left actuators 224 and actuation conditions (e.g., duration, amplitude, frequency) to control fluid flow through the channel 500, and first and second fluid feed holes 214 and 216, in either direction. While only one example is discussed, a number of different operational combinations for this multi-pulse mode are available.

Figure 7:
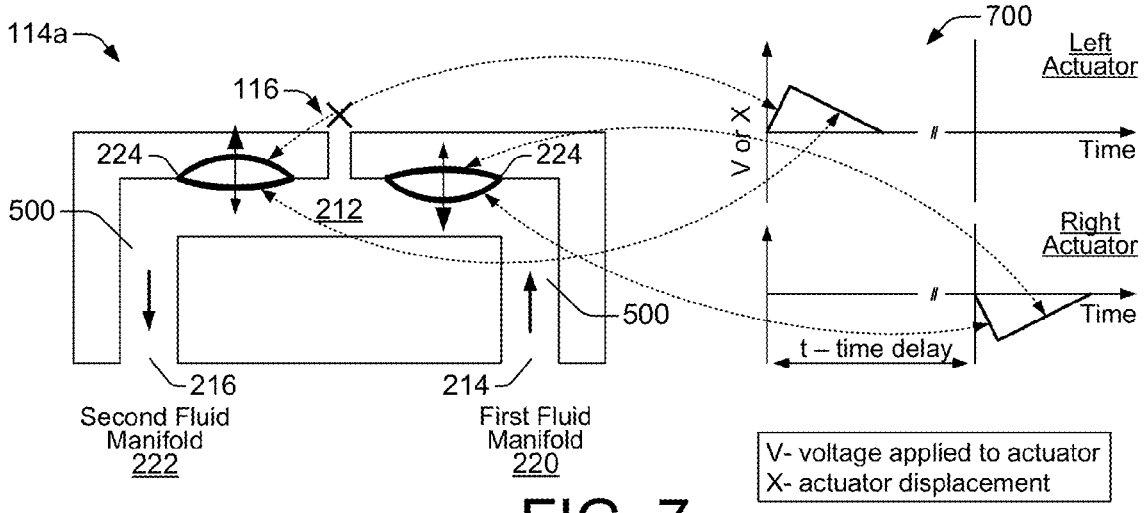
FIG. 7 shows a cross-sectional view of a fluid ejection device with fluid displacement actuators operating in an alternating multi-pulse actuation mode, according to an embodiment.

FIG. 7 shows a simplified cross-sectional view of a fluid ejection device 114*a* with fluid displacement actuators 224 operating in an alternating multi-pulse actuation mode, according to an embodiment of the disclosure. In this embodiment, the multi-pulse actuation module 128 executing on controller 110 controls the actuators 224 in a multi-pulse actuation that activates the left and right actuators in an alternating manner that has fluid displacements that are opposite to those discussed regarding FIG. 6. Thus, the multi-pulse actuation provides a double pumping action that results in strong net directional fluid flow through channel 500 in the opposite direction than in the FIG. 6 embodiment.

As shown in graph 700 of FIG. 7, the multi-pulse actuation module 128 controls the right and left actuators 224 so that they are activated in an alternating manner. However, in the FIG. 7 embodiment, the expansive and compressive fluid displacements are reversed. FIG. 7 shows a stronger expansive displacement and larger deflection of the left actuator associated (by dotted arrow lines) with a voltage change that is temporally shorter and more steeply sloped. FIG. 7 shows a weaker compressive displacement and smaller deflection of the left actuator associated (by dotted arrow lines) with a voltage change that is temporally longer and gradually sloped. This operation of the left side actuator results in net fluid flow through the channel 500 in a direction from the long side of channel 500 (with respect to the left actuator) at the first fluid feed hole 214 toward the short side at the second fluid feed hole 216. The double action pumping from the left and right side actuators in a phase defined by graph 600 and the time and phase delay equations noted above result in a stronger net fluid flow through channel 500 than is available when only one actuator operates as a pump.

Figure 8:
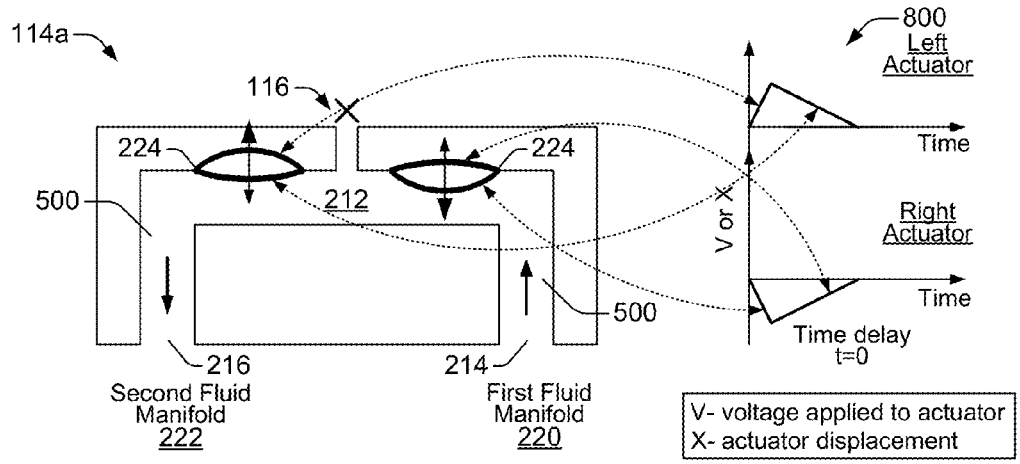
FIG. 8 shows a cross-sectional view of a fluid ejection device with fluid displacement actuators operating in a simultaneous multi-pulse actuation mode, according to an embodiment.

FIG. 8 shows a simplified cross-sectional view of a fluid ejection device 114*a* with fluid displacement actuators 224 operating in a simultaneous multi-pulse actuation mode, according to an embodiment of the disclosure. In this embodiment, the multi-pulse actuation module 128 controls the right and left actuators 224 so that they are activated simultaneously (i.e., with no time delay) but with displacements that are opposite one another. That is, while the right side actuator has a short expansive fluid displacement with a larger deflection, the left side actuator has a short compressive fluid displacement with a larger deflection. Likewise, while the right side actuator has a long expansive fluid displacement with a smaller deflection, the left side actuator has a long compressive fluid displacement with a smaller deflection. As noted above, these fluid displacements create a net directional fluid flow through the channel 500 from the first fluid feed hole 214 to the second fluid feed hole 216.

Figure 9:
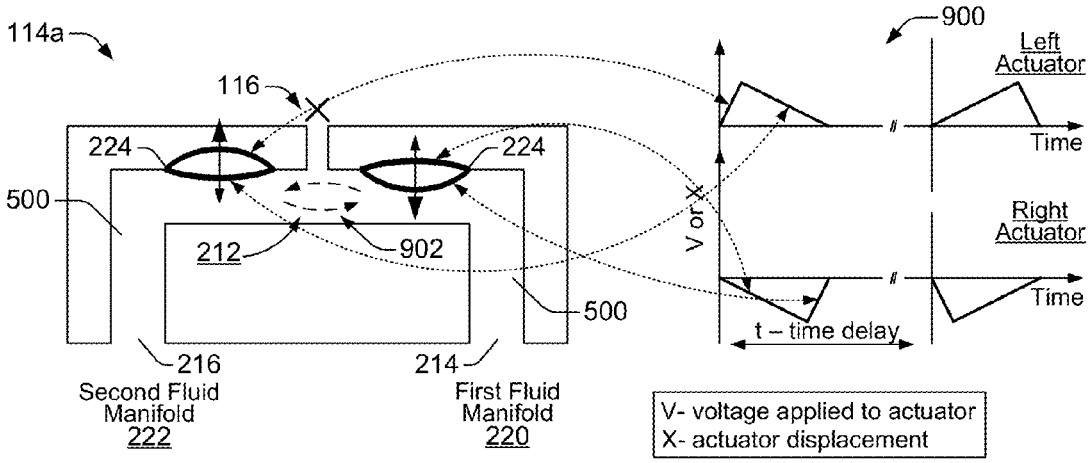
FIG. 9 shows a cross-sectional view of a fluid ejection device with fluid displacement actuators operating in a simultaneous multi-pulse actuation mode, according to an embodiment.

FIG. 9 shows a simplified cross-sectional view of a fluid ejection device 114*a* with fluid displacement actuators 224 operating in a simultaneous multi-pulse actuation mode, according to an embodiment of the disclosure. In this embodiment, the in-chamber circulation module 130 controls the right and left actuators 224 so that they are activated simultaneously and in different displacement phases. Thus, as shown in FIG. 9, while the left side actuator has a short duration expansive fluid displacement followed by a long duration compressive fluid displacement, the right side actuator has, respectively, a long duration compressive displacement followed by a short duration expansive displacement. After a time delay, the operation of the actuators continues with a reversal of the compressive and expansive fluid displacements as indicated in graph 900. The operation of the actuators repeatedly alternates compressive and expansive fluid displacements in this manner, creating movement of the fluid within the channel 500 (more specifically, the chamber 212 portion of the channel 500) that sloshes the fluid back and forth between the left actuator and the right actuator forming a local fluid circulation loop 902 within the chamber 212.

Figure 10:
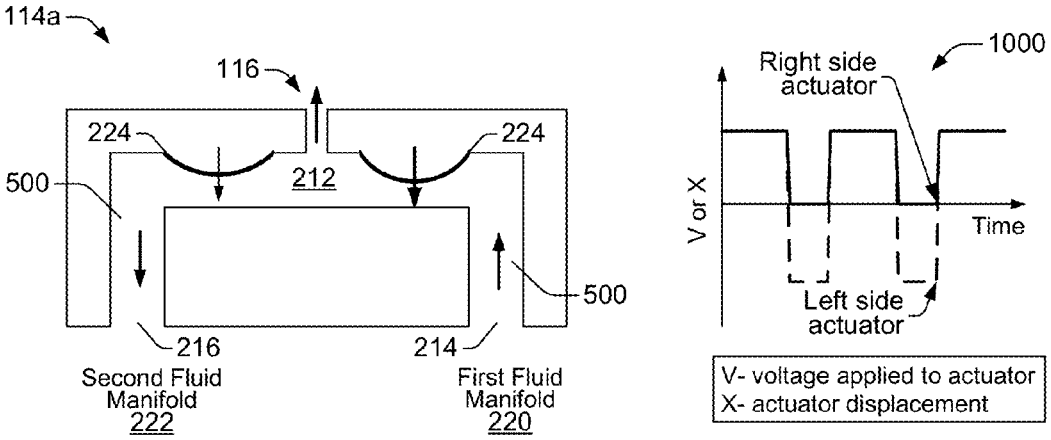
FIG. 10 shows a cross-sectional view of a fluid ejection device with fluid displacement actuators operating in a simultaneous in-phase actuation mode, according to an embodiment.

FIG. 10 shows a simplified cross-sectional view of a fluid ejection device 114*a* with fluid displacement actuators 224 operating in a simultaneous in-phase actuation mode, according to an embodiment of the disclosure. In this embodiment, the drop-eject circulation module 132 controls the right and left actuators 224 so that they are activated simultaneously and in the same compressive displacement phases. As discussed above with respect to FIG. 3*a*, this type of simultaneous, same-phase compressive displacement actuation of both left and right actuators 224 typically results in a drop ejection. This is also the case in the present embodiment of FIG. 10. However, in the FIG. 10 embodiment, the amplitudes of the voltage waveforms driving the left side and right side actuators 224 are different as shown in the graph 1000. Accordingly, there is a greater fluidic displacement created by the right side actuator than by the left side actuator. The drop-eject circulation module 132 controls the right and left actuators 224 to generate simultaneous compressive fluid displacements with enough energy to eject a fluid drop through nozzle 116. In addition, the extra compressive fluid displacement from the right side actuator generates a net directional fluid flow in the channel 500 from the first fluid feed hole 214 toward the second fluid feed hole 216. In another embodiment (not shown), the left side actuator can be driven with a larger voltage waveform than the right side actuator, creating additional compressive fluid displacement from the left side actuator that generates a net directional fluid flow in the channel 500 from the second fluid feed hole 216 toward the first fluid feed hole 214.

Figure 11:
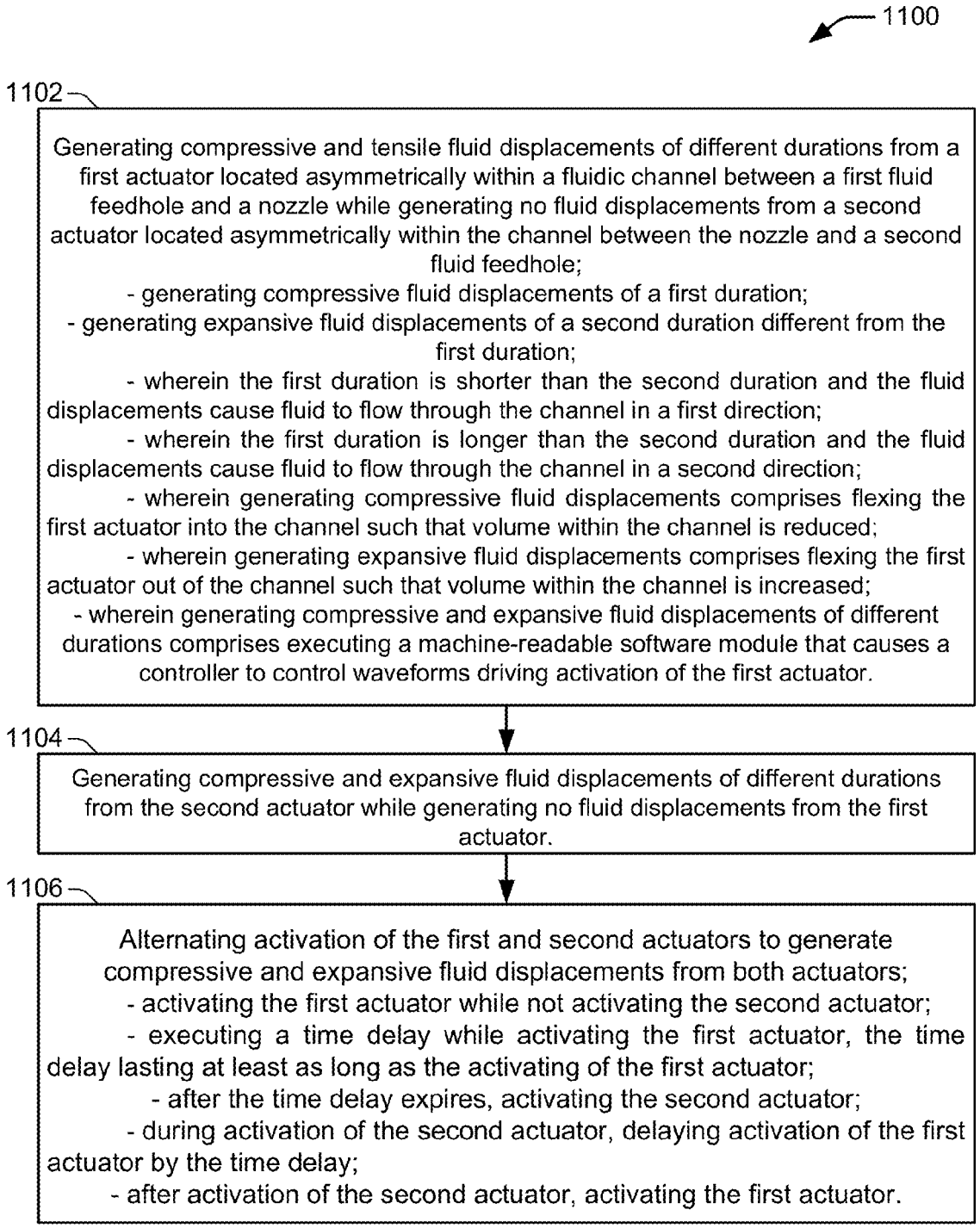
FIG. 11 shows a flowchart of an example method of circulating fluid in a fluid ejection device, according to an embodiment.

FIG. 11 shows a flowchart of an example method 1100 of circulating fluid in a fluid ejection device 114 (e.g., a printhead), according to an embodiment of the disclosure. Method 1100 is associated with the embodiments discussed herein with respect to FIGS. 1-10. Method 1100 begins at block 1102 with generating compressive and expansive fluid displacements of different durations from a first actuator 224 while generating no fluid displacements from a second actuator 224. The first actuator is located asymmetrically within a fluidic channel 500 between a first fluid feed hole 214 and a nozzle 116, and the second actuator is located asymmetrically within the channel between the nozzle and a second fluid feed hole 216.

In one implementation, generating compressive and expansive fluid displacements includes generating compressive fluid displacements of a first duration and generating expansive fluid displacements of a second duration different from the first duration. In one implementation, the first duration is shorter than the second duration and the fluid displacements cause fluid to flow through the channel in a first direction. In one implementation, the first duration is longer than the second duration and the fluid displacements cause fluid to flow through the channel in a second direction. In one implementation, generating compressive and expansive fluid displacements of different durations includes executing a machine-readable software module that causes a controller to control voltage waveforms driving activation of the first actuator.

In one implementation, generating compressive fluid displacements includes flexing the first actuator into the channel such that area within the channel is reduced. In one implementation, generating expansive fluid displacements includes flexing the first actuator out of the channel such that area within the channel is increased.

The method 1100 continues at block 1104 with generating compressive and expansive fluid displacements of different durations from the second actuator while generating no fluid displacements from the first actuator.

At block 1106 of method 1100, there is alternating activation of the first and second actuators to generate compressive and expansive fluid displacements from both actuators. In one implementation alternating activation includes activating the first actuator while not activating the second actuator. The implementation includes executing a time delay while activating the first actuator, where the time delay lasts at least as long as the activating of the first actuator. After the time delay expires, the method includes activating the second actuator. In one implementation, during activation of the second actuator, activation of the first actuator is delayed by the time delay. After activation of the second actuator, the first actuator is activated.

Figure 12:
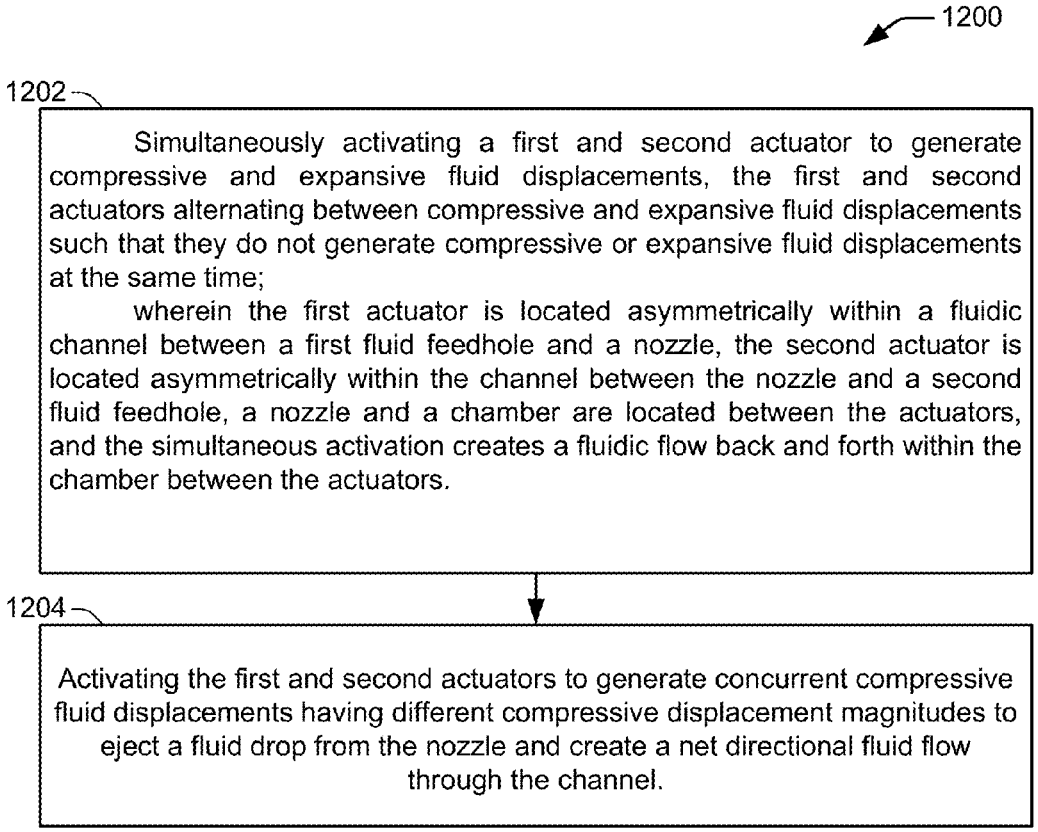
FIG. 12 shows a flowchart of an example method of circulating fluid in a fluid ejection device, according to an embodiment.

FIG. 12 shows a flowchart of another example method 1200 of circulating fluid in a fluid ejection device 114 (e.g., a printhead), according to an embodiment of the disclosure. Method 1200 is associated with the embodiments discussed herein with respect to FIGS. 1-10. Method 1200 begins at block 1202 with generating simultaneously activating a first and second actuator to generate compressive and expansive fluid displacements, where the first and second actuators alternate between compressive and expansive fluid displacements such that they do not generate compressive or expansive fluid displacements at the same time.

In one implementation, the first actuator is located asymmetrically within a fluidic channel 500 between a first fluid feed hole 214 and a nozzle 116, and the second actuator is located asymmetrically within the channel between the nozzle 116 and a second fluid feed hole 216. In one implementation the nozzle 116 and a chamber 212 are located between the actuators, and the simultaneous activation creates a fluidic flow back and forth between the actuators.

At block 1204 of method 1200, the first and second actuators are activated to generate concurrent compressive fluid displacements having different compressive displacement magnitudes to eject a fluid drop from the nozzle and create a net directional fluid flow through the channel.

What is claimed is:

1. A fluid ejection device comprising:

a fluidic channel having a first fluid feedhole, a second fluid feedhole and a nozzle;

a first fluid displacement actuator located asymmetrically within the channel between the first fluid feedhole and the nozzle;

a second fluid displacement actuator located asymmetrically within the channel between the second fluid feedhole and the nozzle; and a controller to control fluid flow through the channel by generating compressive and expansive fluid displacements of different durations from at least one actuator.

2. A fluid ejection device as in claim 1, further comprising a single actuation module to activate one of the first actuator or the second actuator to induce directional fluid flow through the channel.

3. A fluid ejection device as in claim 1, further comprising a multi-pulse actuation module executable on the controller to alternately activate both of the actuators to cause directional fluid flow through the channel, the first fluid feedhole and the second fluid feedhole, but not through the nozzle.

4. A fluid ejection device as in claim 1, further comprising a drop-eject circulation module executable on the controller to simultaneously activate the actuators to generate in-phase actuator deflections that eject a fluid drop through the nozzle and induce directional fluid flow through the channel.

5. A fluid ejection device as in claim 1, further comprising a chamber corresponding with the nozzle and located between the first and second actuators.

6. A fluid ejection device as in claim 5, further comprising an in-chamber circulation module executable on the controller to simultaneously activate the actuators to generate counter-phase actuator deflections that circulate fluid within the chamber but not through the first fluid feedhole, the second fluid feedhole, or the nozzle.

7. A method of circulating fluid in a fluid ejection device, comprising generating compressive and expansive fluid displacements of different durations from a first actuator located asymmetrically within a fluidic channel between a first fluid feedhole and a nozzle while generating no fluid displacements from a second actuator located asymmetrically within the channel between the nozzle and a second fluid feedhole.

8. A method as recited in claim 7, wherein generating compressive fluid displacements comprises flexing the first actuator into the channel such that volume within the channel is reduced.

9. A method as recited in claim 7, wherein generating expansive fluid displacements comprises flexing the first actuator out of the channel such that volume within the channel is increased.

10. A method as recited in claim 7, wherein generating compressive and expansive fluid displacements of different durations comprises executing a machine-readable software module that causes a controller to control waveforms driving activation of the first actuator.

11. A method as in claim 7, further comprising generating compressive and expansive fluid displacements of different durations from the second actuator while generating no fluid displacements from the first actuator.

12. A method as in claim 11, further comprising alternating activation of the first and second actuators to generate compressive and expansive fluid displacements from both actuators.

13. A method as in claim 12, wherein alternating activation of the first and second actuators comprises:

activating the first actuator while not activating the second actuator;

executing a time delay while activating the first actuator, the time delay lasting at least as long as the activating of the first actuator; and after the time delay expires, activating the second actuator.

14. A method as in claim 13, wherein alternating activation of the first and second actuators further comprises:

during activation of the second actuator, delaying activation of the first actuator by the time delay; and after activation of the second actuator, activating the first actuator.

15. A method as in claim 7, wherein generating compressive and expansive fluid displacements of different durations comprises:

generating compressive fluid displacements of a first duration; and, generating expansive fluid displacements of a second duration different from the first duration.

16. A method as recited in claim 15, wherein the first duration is shorter than the second duration and the fluid displacements cause fluid to flow through the channel in a first direction.

17. A method as recited in claim 16, wherein the first duration is longer than the second duration and the fluid displacements cause fluid to flow through the channel in a second direction.

18. A method of circulating fluid in a fluid ejection device, comprising:

simultaneously activating a first and second actuator to generate compressive and expansive fluid displacements, the first and second actuators alternating between compressive and expansive fluid displacements such that they do not generate compressive or expansive fluid displacements at the same time;

wherein the first actuator is located asymmetrically within a fluidic channel between a first fluid feedhole and a nozzle, the second actuator is located asymmetrically within the channel between the nozzle and a second fluid feedhole, a nozzle and a chamber are located between the actuators, and the simultaneous activation creates a fluidic flow back and forth within the chamber between the actuators.

19. A method as in claim 18, wherein simultaneously activating the first and second actuator comprises activating the first and second actuators to generate concurrent compressive fluid displacements having different compressive displacement magnitudes to eject a fluid drop from the nozzle and to create a net directional fluid flow through the channel.

* * * * *